US006260398B1

(12) United States Patent
Cisko et al.

(10) Patent No.: US 6,260,398 B1
(45) Date of Patent: Jul. 17, 2001

(54) FORMING OF HOLLOW EXTRUSIONS WITH DOUBLE PLANE BENDS AND TWISTS

(75) Inventors: Larry W. Cisko, Harrison City; Blair T. Allison, Grove City; William A. Graham, McDonald; Paul E. Ringbloom, Murrysville, all of PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/502,684

(22) Filed: Feb. 11, 2000

(51) Int. Cl.[7] ..... B21D 25/02; B21D 11/14
(52) U.S. Cl. ..... 72/302; 72/299
(58) Field of Search ..... 72/302, 299, 297

(56) References Cited

U.S. PATENT DOCUMENTS

| | | | | |
|---|---|---|---|---|
| 2,297,055 | * | 9/1942 | Grad | 72/299 |
| 2,352,442 | * | 6/1944 | Loewy | 72/302 |
| 2,369,515 | * | 2/1945 | Amiot | 72/302 |
| 4,704,886 | | 11/1987 | Evert et al. | 72/57 |
| 4,827,753 | * | 5/1989 | Moroney | 72/302 |
| 5,323,631 | * | 6/1994 | Weykamp | 72/296 |
| 5,349,839 | | 9/1994 | Weykamp et al. | 72/296 |
| 5,735,160 | | 4/1998 | VanSumeren et al. | 72/296 |
| 5,737,953 | | 4/1998 | Allison et al. | 72/58 |
| 5,836,193 | | 11/1998 | Hunter et al. | 72/298 |
| 5,848,546 | | 12/1998 | Allison et al. | 72/296 |

* cited by examiner

*Primary Examiner*—Daniel C. Crane
(74) *Attorney, Agent, or Firm*—Robert D. Kucler; Thomas R. Trempus

(57) ABSTRACT

A method and apparatus for forming hollow extrusions. Specifically, a method and apparatus for imparting one or more bends and/or twists in a hollow extrusion under stretch. The apparatus may perform all of these formation and stretch functions as the result of one single physical or mechanical force imparted on the apparatus from either an internal or an external source. The forming apparatus and method may provide an easy way to mount and/or dismount the hollow extrusion form the machine by way of separate or integral gripper mounts. The single-force stretch-bend-twist apparatus may be used in a mass production manufacturing environment where the machine and method can perform complex formation steps and may automatically reset itself back to a starting position after formation.

19 Claims, 13 Drawing Sheets

FORMING OF HOLLOW EXTRUSIONS WITH DOUBLE PLANE BENDS AND TWISTS

FIELD OF THE INVENTION

The present invention generally relates to a hollow extrusion bending apparatus and method. More particularly, the present invention relates to a hollow extrusion bending apparatus and method wherein the extrusion is bent in two perpendicular planes and twisted.

BACKGROUND OF THE INVENTION

In the metal forming arts, there are known a variety of stretch-forming techniques in which a workpiece, usually an elongated extrusion or a sheet-form member, is formed to the profile of a forming die surface in conjunction with the application to the workpiece of tension exceeding its yield point. The tension is applied along the line coinciding with the bend axis of the workpiece that is deformed during the forming process.

The known stretch-forming processes typically have been applied in the forming of aluminum alloy components such as elongated extrusion sections or thin section panels like those often used for aircraft fuselage skin.

One known stretch-forming process, for example, is often referred to as "stretch wrapping" or "stretch-wrap forming" and involves the application of mechanical tension to a workpiece to thereby stretch it during formation. Subsequently, while the tension is maintained, the workpiece is wrapped about a form die. When a hollow extrusion is bent over a form die without being under tension, the resulting compressive forces on the inner surface of the extrusion cause this inner surface to buckle or deform. The basic goal of stretch-wrap forming is to stretch the extrusion along its bend axis to a point where the inner surface will not deform when subsequently bent over a form die. Stretch-wrap forming may be well suited to forming a workpiece to long sweeping curvatures of liberal radii.

Other stretch-forming techniques include moving die arrangements, in which the gripping heads are stationary and the forming die is moved perpendicular into the workpiece. Another technique is radial draw forming, in which one grouping head and the die are mounted on a table that rotates to slowly draw the part under tension over the rotating die.

An advantage of the various stretch-forming processes may generally include a decrease or elimination of the buckling of the inner surface of the workpiece. Furthermore, the desired results may be achieved with only minimal reduction in workpiece section thickness, typically not exceeding a five percent reduction.

However, the above stretch-forming processes generally require an unacceptable amount of human interaction and may not be suitable for a mass production environment. Also, imparting additional bends or even twists in the extrusion typically requires additional, time-consuming process steps whereby the extrusion may be dismounted from one bending machine, remounted in another, and then bent again. These extra process steps slow down the overall extrusion forming process and can not easily be accomplished by an automated assembly line.

In view of the foregoing, a need has been recognized in connection with the provision of a multiple bend or twist apparatus and method for use in a mass production environment. The apparatus can be used with limited human interaction and is well suited to an automated environment.

Generally, the apparatus and method may form more complex extrusions in one process step and in a decreased amount of time compared to current methods. The profiles of the various stretches, bends, and twists may be precisely controlled and need not be constant throughout the forming process.

SUMMARY OF THE INVENTION

The present invention, in accordance with at least one presently preferred embodiment, generally contemplates a method and apparatus for forming hollow extrusions with one or more bends and/or twists. Preferably, the apparatus can impart one or more of the forming operations described above in one process step. Typically, this process step can be largely automated, and the amount of stretch, bend, or twist can be precisely controlled and need not be constant throughout the forming process.

In one presently preferred embodiment, a hollow extrusion can be mounted with gripper mounts and then secured in the bending apparatus. With one mechanical motion, the apparatus may stretch the extrusion along its longitudinal axis and bend the extrusion in a plane that is perpendicular to that axis. The transfer of motion from the applied mechanical force to the stretching and bending process may be accomplished with a cam and follower arrangement.

In another presently preferred embodiment of the present invention, a single mechanical motion applied to the apparatus may be translated into a stretching of a mounted extrusion along its longitudinal axis as well as a twisting of the part around this same axis. This motion translation may be accomplished by any of a variety of commonly known processes in the mechanical or other engineering arts.

In still another presently preferred embodiment of the present invention, the apparatus and method may stretch a mounted extrusion along its longitudinal axis while bending the extrusion in one or more planes while also twisting the extrusion. An almost limitless combination of various bends and twists can be imparted to an extrusion in accordance with the present invention.

BRIEF DESCRIPTION OF THE DRAWINGS

The present invention and its presently preferred embodiments will be better understood by reference to the detailed disclosure hereinbelow and to the accompanying drawings, wherein.

DESCRIPTION OF THE PREFERRED EMBODIMENTS

Figure 1:
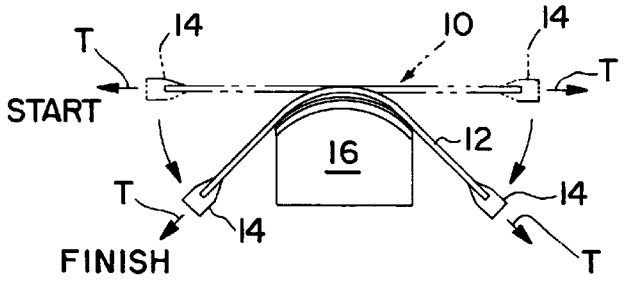
FIG. 1 PRIOR ART
FIG. 1 shows a conventional stretch-wrap extrusion forming process.

There is generally indicated at 10 in FIG. 1 a fragmentary portion of a conventional stretch-wrap forming apparatus which is utilized to form an elongated workpiece 12 to a desired shape. For purposes of simplification and clarity, apparatus 10 is shown in schematic form. Apparatus 10 comprises a pair of spaced-apart grippers 14 which are initially aligned in the position designated by hidden lines and labeled "START." The grippers 14 secure the opposite ends of workpiece 12, and suitable known tension arrangements such as hydraulic piston-cylinder assemblies (not shown) apply to the workpiece a tension T of sufficient magnitude to exceed the elastic limit of the workpiece. While tension T is maintained, the grippers 14 are rotated to the position designated "FINISH" to form the workpiece 12 over a forming die 16. Throughout the forming process the tension T is maintained in alignment with the bend axis extending longitudinally through the workpiece 12.

Figure 2:
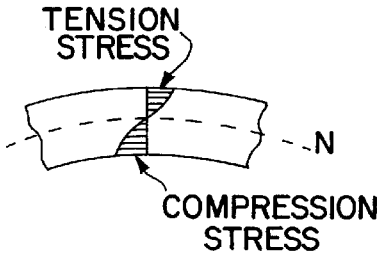
FIG. 2 generally shows the stress distribution in a workpiece during a conventional extrusion bending process.
Figure 3:
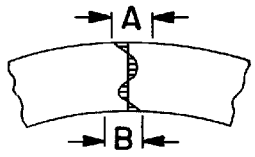
FIG. 3 generally shows the residual stress distribution in a workpiece after springback of a conventional extrusion bending process.

FIGS. 2 through 5 are illustrative of some of the differences between stretch-wrap forming as above characterized, and conventional bending. Upon bending a hollow extrusion, a stress distribution is typically imparted on the workpiece according to FIG. 2. A neutral axis N defines a portion of the extrusion that is stress-free upon bending. The material on the radially inner side of the neutral axis N is placed in mechanical compression while the material on the opposite or radially outer side of the neutral axis N is placed in mechanical tension as shown in FIG. 2. With sufficient bending load, the tensile and compressive stresses will at certain locations exceed the elastic limit of the workpiece material, and plastic deformation will occur. Upon release of the bending load, the workpiece will have a residual stress profile according to FIG. 3. Because of the stresses imparted on the extrusion during bending, the radially inner surface of the hollow extrusion may buckle or deform.

Figure 4:
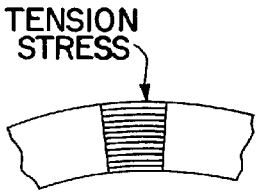
FIG. 4 generally shows the stress distribution in a workpiece during a stretch-form extrusion bending process.
Figure 5:
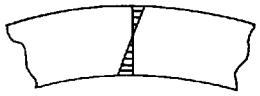
FIG. 5 generally shows the residual stress distribution in a workpiece after springback of a stretch-form extrusion bending process.

From FIGS. 4 and 5, it will be seen that the stress loading imposed on a workpiece during stretch-wrap forming differs markedly from that occurring during a pure bending operation. As the workpiece is bent, it is stretched to keep the radially inner surface compression-free or in tension, to produce a stress distribution similar to that shown in FIG. 4. Hence, the radially inner surface will not buckle or deform through the bending process. However, care must be taken that the tension not exceed a point that will fail the radially outer surface of the extrusion. FIG. 5 shows the simpler nature of the resulting residual stresses imposed on the extrusion after bending.

Many conventional stretch-forming methods are time consuming and require complicated machinery. As such, they may not be very conducive to use in a manufacturing environment. Also, these conventional stretch forming methods may not be able to impart more than one bend or a bend and at least one twist in the hollow extrusion being formed. As such, a need has been recognized in connection with providing an apparatus and method capable of forming hollow extrusions with at least one bend, or at least one bend and at least one twist, in one manufacturing process.

Figure 7:
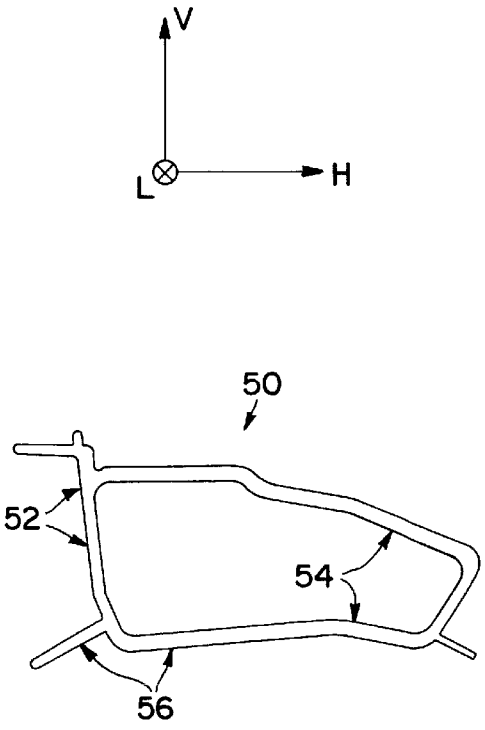
FIG. 7 shows a side view of the extrusion of FIG. 6.
Figure 6:
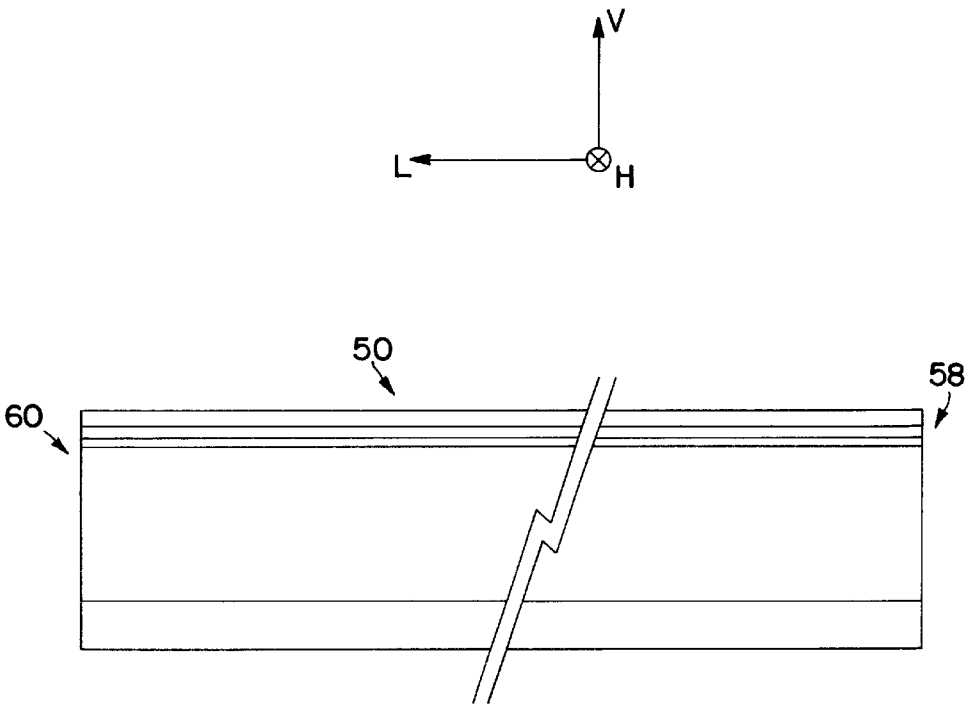
FIG. 6 shows a front view of an extrusion for use in accordance with at least one embodiment of the present invention.

FIGS. 6 and 7 generally depict a front and side view, respectively, of a typical hollow extrusion 50 to be bent and twisted in accordance with a preferred embodiment of the present invention. FIG. 7 shows a cross section of the hollow extrusion 50 before bending. The extrusion has a profile 52 which is defined by an inner wall 54 and an outer wall 56 which extend along the entire longitudinal axis of the extrusion. FIG. 6 shows a front view of the same extrusion 50 before bending. This extrusion 50 is shown only for purposes of example, and it is understood that any material extrusion, with any of an infinite possible number of configurations, is implied by the use of this example.

For purposes of clarity with respect to the rest of this disclosure, the hollow extrusion 50 is shown with a first end 58 and a second end 60. Also, three major axes are shown in the figures. A longitudinal axis L runs parallel to an elongated dimension of the extrusion 50. A vertical axis V is oriented perpendicular to the longitudinal axis L and runs generally from a bottom of the apparatus to a top of the apparatus. Finally, a horizontal axis H runs perpendicular to both the longitudinal L and vertical V axes. The horizontal axis H runs generally parallel to an imaginary surface upon which the base of the apparatus may sit. These axes have been introduced only to facilitate understanding of the orientation of the material when mounted on the bending apparatus. In no way does the position or selection of these particular axes limit the structure or operation of the disclosed apparatus and method for bending and/or twisting extrusions.

Figure 9:
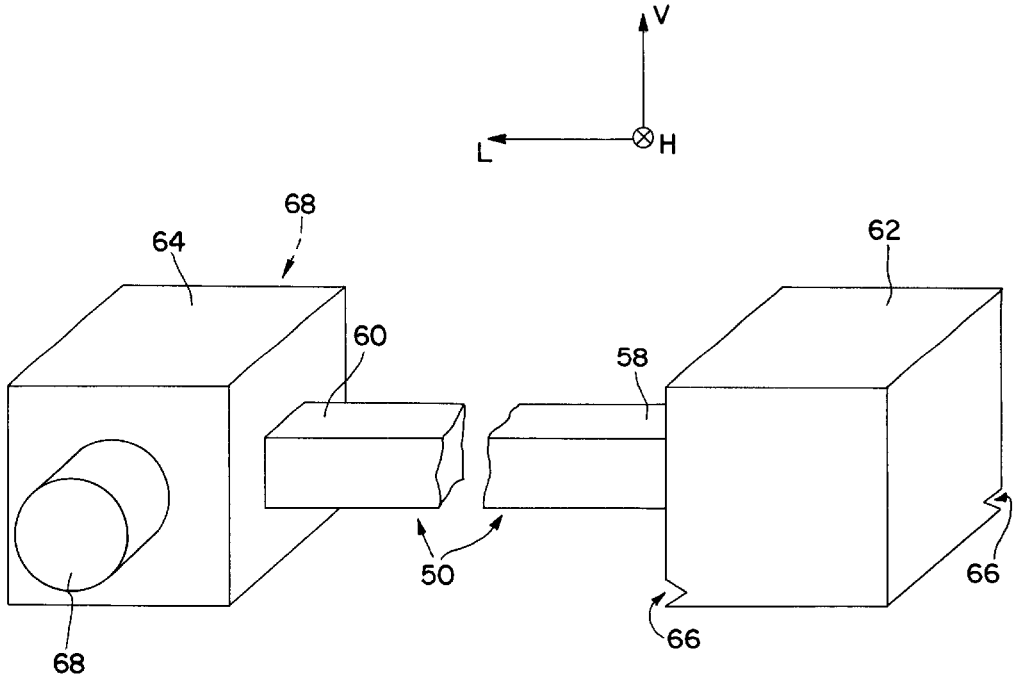
FIG. 9 shows an isometric view of an extrusion with gripper mounts.

Typically, prior to loading the extrusion 50 to be bent and/or twisted, the extrusion 50 is mounted in a pair of mounting grippers 62, 64 (see FIG. 9) that allow the extrusion 50 to be quickly mounted and dismounted from a bending apparatus 100 (see FIG. 9). Such a gripping mechanism 62, 64 may increase the speed with which multiple extrusions 50 can be bent or twisted on the bending apparatus 100 as in a manufacturing assembly line environment.

FIGS. 8A–8D show a gripper mounting that can be utilized in conjunction with the embodiments of the present invention. FIG. 9 shows an extrusion 50 with gripper mounts 62, 64 removably mounted at each end of the extrusion 50.

Although the extrusion 50 is shown and described with removable gripper mounts 62, 64 throughout the instant disclosure, an inventive apparatus could also contain the gripper mounts 62, 64 as an integral part of the bending apparatus 100. Hence, rather than mounting the gripper mounts 62, 64 on the extrusion 50 before mounting the extrusion in the bending machine 100, the extrusion could, in the alternative, be brought directly to the machine 100 where it could then be mounted in integral gripper mounts 62, 64 to hold the extrusion while the extrusion is bent and/or twisted.

Figure 8A:
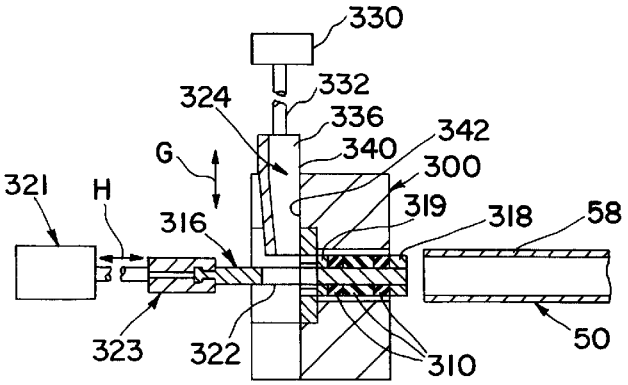
FIGS. 8A–8D depict the mounting of an extrusion with gripper mounts.
Figure 8B:
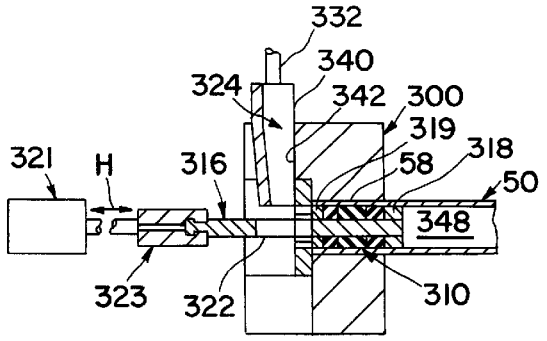
Figure 8C:
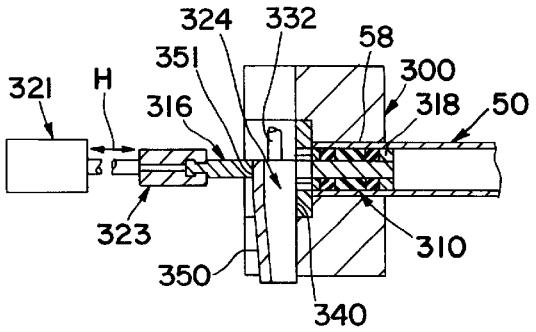
Figure 8D:
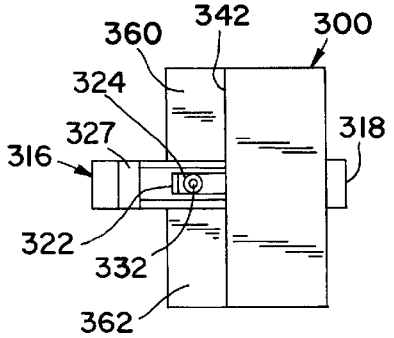

With respect to FIGS. 8A–8D, an arrangement for effecting and maintaining axial compression to effect gripping of the ends of generally tubular extrusion 50 is contemplated. FIG. 8A shows the gripper and extrusion 50 before mounting. An outer tool 300, having a recess for receiving end 58 of extrusion 50, receives a resilient mandrel 310 which, in the form shown, includes a plurality of segments of generally annular shape having a pull rod 316 extending therethrough. A metal cap 318 is secured to the end of the pull rod 316 closest to the extrusion 50. Metal retainer cap 319 slidingly receives the pull rod 316 on the other side of the resilient mandrel 310. The pull rod 316 has a generally axially oriented wedge-receiving opening 322 (FIGS. 8A, 8B and 8D). In the form shown, the upper portion 336 of wedge 324 is generally rectangular in plan.

Figure 10:
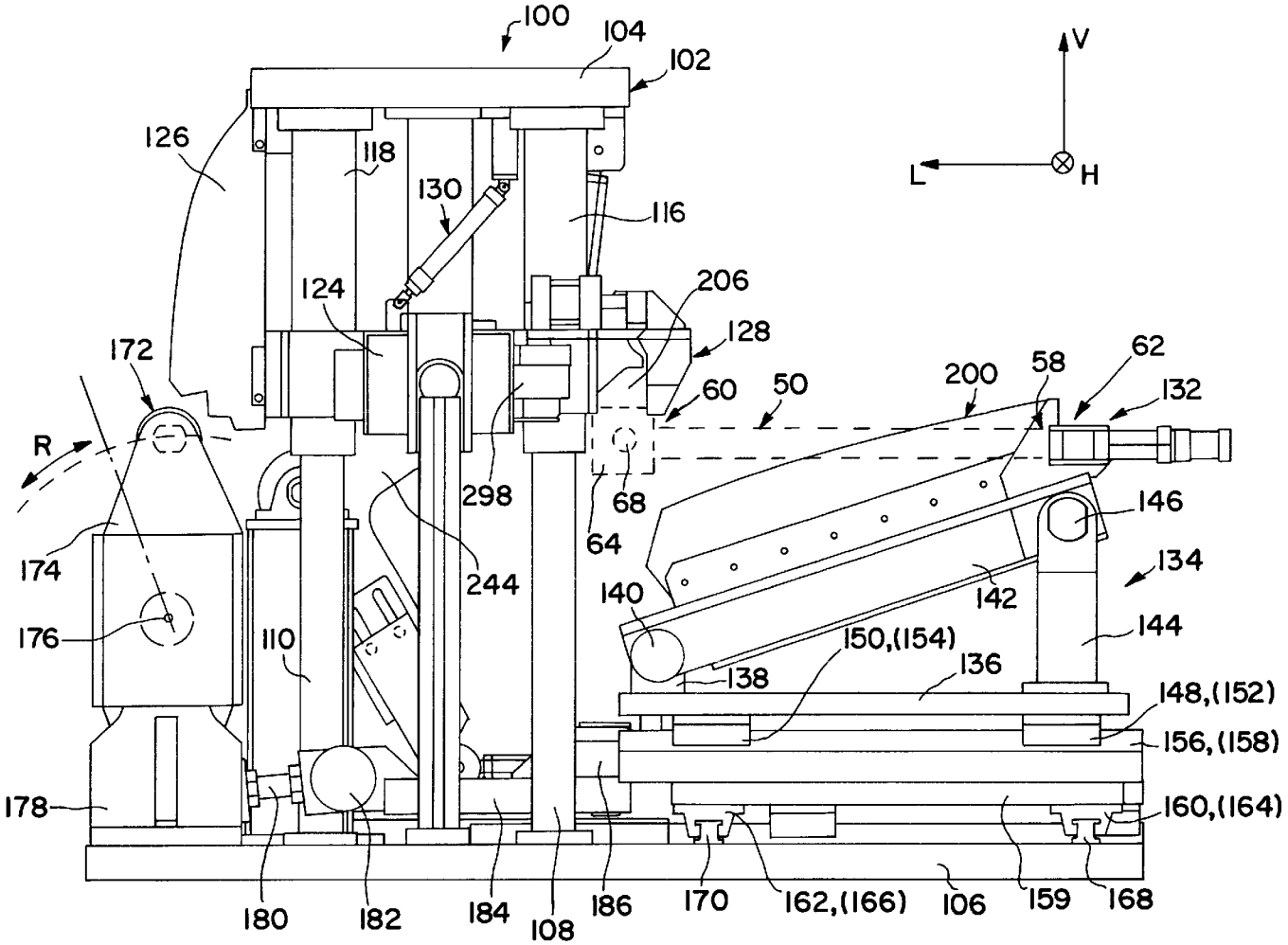
FIG. 10 shows a front view of a forming apparatus according to one embodiment of the present invention.

In FIG. 8A, the workpiece 50 has not entered tool 300 and, in FIG. 8B, it has. In operation, hydraulic cylinder 321 (or other mechanical actuator) applies reciprocating movement in the direction of double headed arrow H which, through notched coupling 323, is interengaged with pull rod 316. When the pull rod 316 is moved to the left, end cap 318 causes axial compression and radial expansion of resilient mandrel 310, thereby holding the extrusion 50 against the tool 300. As shown in FIG. 8C, wedge 324 is then lowered into wedge receiving opening 322 with wedge flat surface 340 and wedge tapered surface 350 serving to guide the wedge 324. Flat surfaces 340, 351 will retain the wedge in opening 322 to retain the resilient mandrel in clamping or gripping position without any ongoing action of hydraulic cylinder 321. Therefore, the extrusion 50 with gripper mounts 62, 64 can be removed from the gripper mounting cylinder 321 and brought to the bending apparatus 100 (FIG. 10). Note in FIG. 8C that end cap 318 has been pulled into the tool 300 by force of the hydraulic cylinder 321 and the wedge 324.

After forming the extrusion 50, the cycle is reversed, to resume the position of FIG. 8A. The wedge 324, therefore, reciprocates in the direction of double headed arrow G. During movement of wedge 324, wedge surface 340 is in sliding contact with tool surface 342. The gripper mounts as just described may be useful because they can grip and hold the extrusion without themselves deforming the extrusion. Other claw and gripping devices may pierce, puncture, bend, or otherwise deform the extrusion during gripping.

FIG. 9 shows an isometric view of the extrusion 50 after being mounted with two gripper mounts 62, 64. Typically, a first mount 62 will contain one or more grooves 66 or other suitable arrangement that allow this end of the extrusion 50 to be securely mounted to a portion of the bending apparatus 100 (FIG. 10). These grooves 66 or other media are preferably configured for interfacing with groove acceptors or other attaching acceptance devices located on the bending apparatus 100. Typically, this first gripping device 62 allows the extrusion 50 to be mounted and dismounted quickly as part of an assembly line-type production.

The other gripper mount 64 typically contains two extending cylinders 68 that are oriented perpendicularly with respect to the longitudinal axis L of the extrusion 50. These cylinders 68 provide a medium for the bending apparatus to dynamically lock onto the extrusion 50 and stretch, bend, or twist the extrusion 50 during the extrusion formation process. These attached cylinders 68 may provide an easy and quick medium for mounting or dismounting the extrusion 50 from the bending and/or twisting apparatus as part of an assembly line-type manufacturing process.

Figure 11:
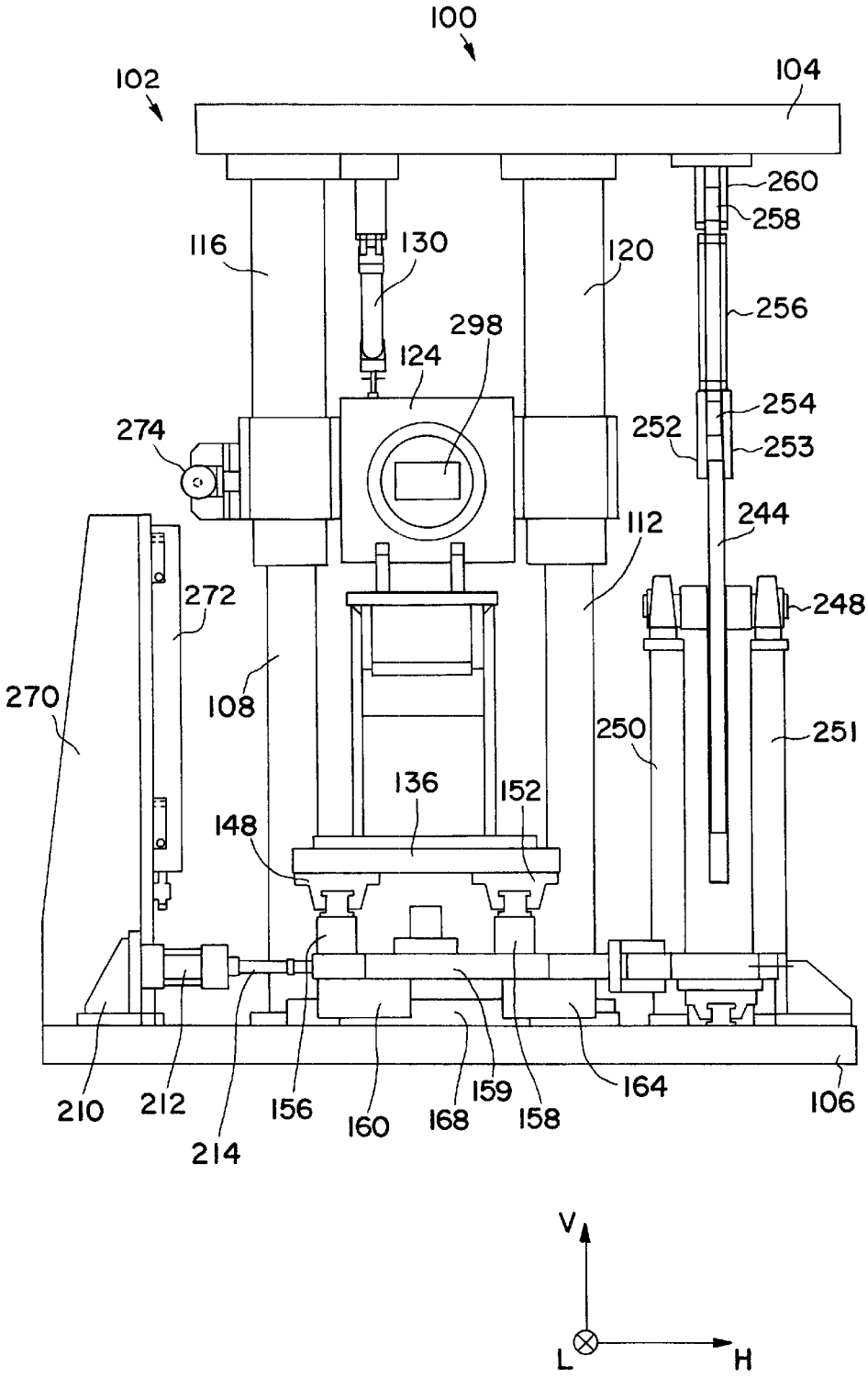
FIG. 11 shows a side view of the apparatus of FIG. 10.
Figure 12A:
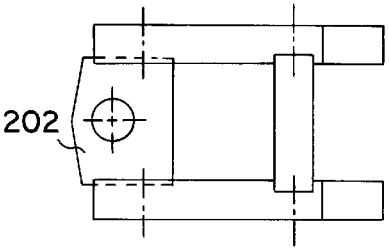
FIGS. 12A–12D depict top, partial side, bottom, and full side views, respectively, of a gripper hook.
Figure 12C:
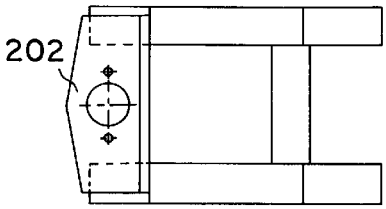
Figure 12B:
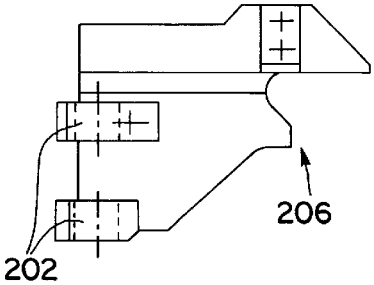
Figure 12D:
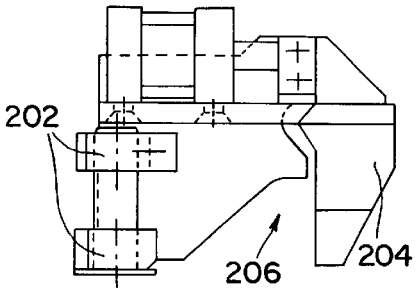

FIGS. 10 and 11 generally show a front and side view of one preferred embodiment of an apparatus for forming extrusions. This exemplary embodiment affords the capability of stretch-forming the extrusion by bending the extrusion in two perpendicular planes and twisting the extrusion about and along the longitudinal axis L of the extrusion. A brief overview of the depicted apparatus 100 will first be given, followed by a more detailed description.

FIGS. 10 and 11 illustrate a bending apparatus 100 capable of stretching a hollow extrusion 50 (shown in dotted lines) along its longitudinal axis L while bending the extrusion in two perpendicular planes and twisting the extrusion 50, all in one process step. Bending apparatus 100 essentially encompasses a four post die set that guides movement in a generally vertical direction. The apparatus 100 includes an upper guide member assembly 102 that contains an upper platen 104 that may act as a ram. The apparatus 100 also contains a lower platen or base 106. Four upper guide members 116, 118, 120, 122 are secured to the under side of the upper platen 104 and are spaced evenly near the four corners of the upper platen 104. Likewise, four lower guide members 108, 110, 112, 114 are secured to the top side of the lower platen or base 106 and are correspondingly positioned beneath the upper guide members.

The upper 116, 118, 120, 122 and lower 108, 110, 112, 114 guide members are preferably cylindrical and are configured so that each respective upper guide member 116, 118, 120, 122 can receive a corresponding lower guide member 108, 110, 112, 114 into a hollow recess in the upper guide member. With the base 106 preferably bolted to the floor of the work environment, this allows the upper guide members 116, 118, 120, 122 with attached upper platen 104 to move slidingly along the vertical axis V along the outside of the lower guide members 108, 110, 112, 114 nested therewithin.

The upper guide member assembly 102 also has a bend head 124, a stretch cam 126, a gripper hook 128, and a restoring cylinder 130 affixed thereto. As the upper guide members 116, 118, 120, 122 move up and down along the outside of the lower guide members 108, 110, 112, 114, the entire upper assembly 102 moves up and down also. The function of each of the latter four parts will be explained in more detail below.

The bending apparatus 100 also preferably contains a die pedestal 134 for imparting one bend to the mounted extrusion 50. Generally speaking, this die pedestal 134 contains a fixed clamping device 132 for holding one end 58 of the hollow extrusion 50 and a bend die 200 over which the extrusion 50 will be bent. This first bend occurs along the longitudinal axis L and in the vertical plane. The die pedestal 134 sits atop two sets of linear slides which allow the pedestal 134 (and hence the fixed end 58 of the mounted extrusion 50) to move in either the horizontal or the longitudinal direction. Other components on the forming apparatus 100 may impart other bends or twists to the extrusion 50.

FIG. 10 generally shows the bending apparatus 100 with a mounted extrusion 50 shown in dashed lines. The extrusion 50 is preferably mounted with a fixed end gripper mount 62 at one end 58 and a free end gripper mount 64 at the other end 60 of the extrusion 50. To mount the extrusion 50 in the bending apparatus 100, the slots or grooves 66 of fixed end gripper mount 62 (see FIG. 9) are matched to corresponding tongues in the fixed clamping device 132 on the die pedestal 134. There may be any of a variety of fixed clamping arrangements employed, but the tongue and groove arrangement provides an easy way to mount and dismount the extrusion 50. Note also that the gripper mounts 62, 64 could be integral with the bending apparatus 100 as previously described.

After mounting and/or fixing the fixed end 58 of the extrusion 50 to the fixed clamping device 132, the free end 60 of the extrusion 50 extends out from this point in the positive longitudinal L direction. The dotted lines in FIG. 10 show the free end gripper mount 64 with cylinders 68 extending therefrom. These cylinders 68 will be engaged by the gripper hook 128.

FIGS. 12A–12D, respectively, show a top, partial side, bottom, and full side view of the gripper hook 128. The gripper hook 128 includes a mounting bracket 202 for securing the gripper hook 128 to the gripper hook mount 298 on the bend head 124. The gripper hook 128 can be of various dimensions and shapes, but preferably includes an inverted hook or claw 204 that forms an opening 206. This opening 206 is designed to accept the extending cylinders 68 on the free end gripper mount 64 to grasp and hold the free end 60 of the mounted extrusion 50.

Returning to FIG. 10, the gripper hook 128 is shown with opening 206 just above the extending cylinders 68. The formation process begins by applying a force in the negative vertical direction (downwards) on the upper platen assembly 102. This downward force can come from an automatic hydraulic or mechanical press with ram, or from any other automatic or manual mechanical force application. The actuator may be part of the apparatus 100 (as in a "self-actuated" tool) or it can be external to the bending apparatus 100.

The downward force on upper platen assembly 102 causes the entire assembly, including the gripper hook 128, to move downwards. As the assembly 102 moves down, the extending cylinders 68 on the gripper hook 128 will be engaged by the gripper hook 128. This action will dynamically (or automatically) lock the free end 60 of the extrusion 50 into the gripper hook 128. Hence, the extrusion 50 is held firmly between the fixed clamping device 132 and the upper platen assembly 102. Once the extrusion 50 is held, the upper platen assembly 102 continues downward to perform the stretching, bending, and/or twisting processes described elsewhere herein.

After attaching gripper mounts 62, 64 to the extrusion 50 and loading the extrusion in the bending apparatus 100, the extrusion 50 is ready to be stretched, bent, and/or twisted in accordance with at least one embodiment of the present invention. As explained above, stretching the extrusion 50 to the point of plasticity before bending or twisting may result in less deformation or warping of the extrusion 50 when the bending stresses are removed. In at least one presently preferred embodiment of the present invention, the extrusion 50 to be bent and/or twisted is stretched during the entire formation process.

As shown in FIG. 10 the upper platen assembly 102 includes a stretch cam 126 with a stretch profile. There is also a stretch cam follower 172 that follows the stretch cam 126 profile to impart a longitudinal L stretch on the extrusion 50 throughout the formation process. The cam follower 172 is attached to a stretch cam member 174 that is pivotally mounted on a stretch cam support 178. The stretch cam support 178 is securely fastened to the lower platen or base 106 at one end and has an axle or shaft 176 at its other end. The stretch cam member 174 is attached to this shaft 176 near its midpoint, enabling the stretch cam member to rotate about the axis of shaft 176 along radial arc R in FIG. 10.

Figure 13:
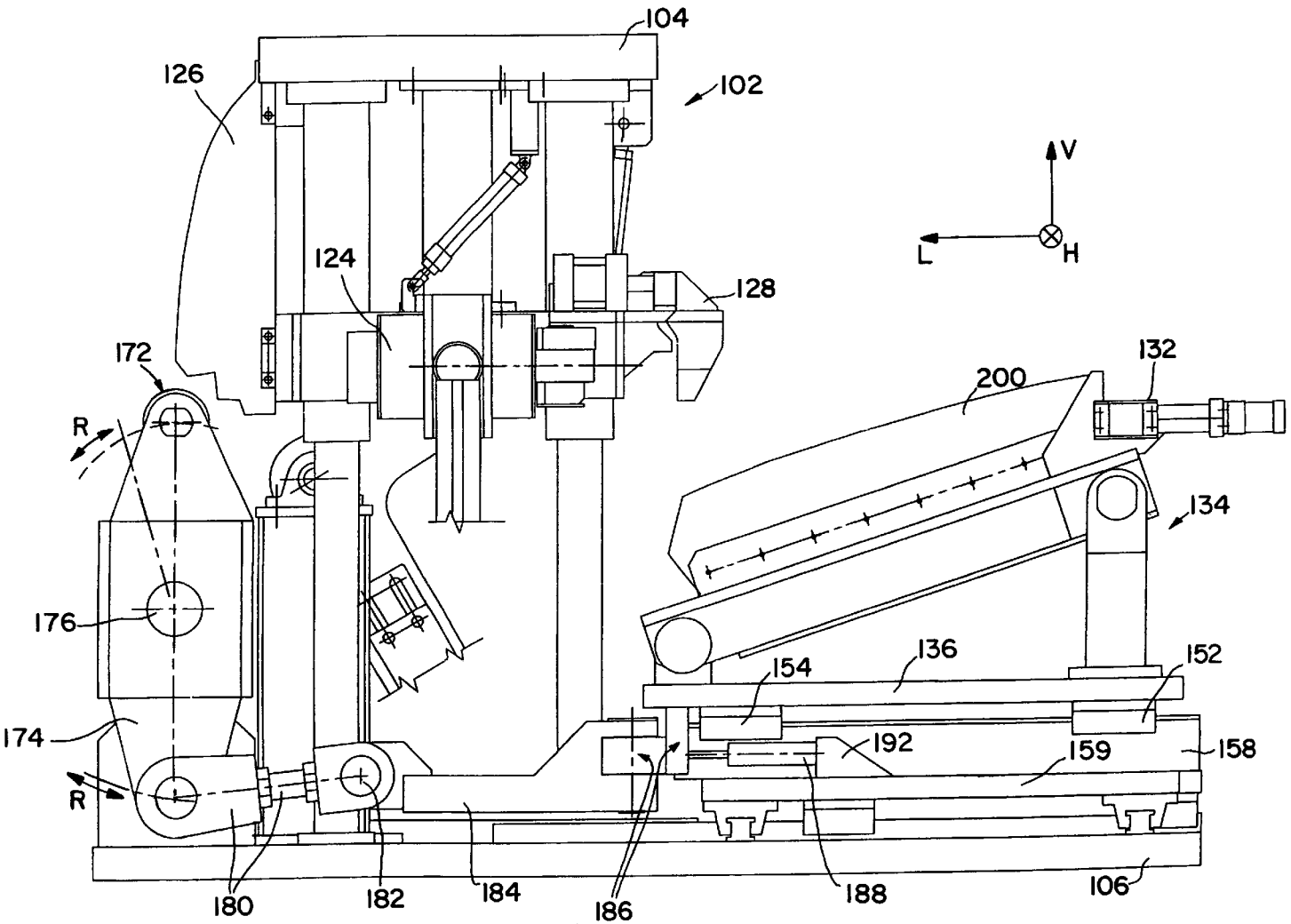
FIG. 13 shows substantially the same view as FIG. 10 with some components removed to detail a bending process.

FIG. 13 shows a side elevational view of the apparatus of FIG. 10, with certain components removed to aid in viewing the operation of the stretching components. The lower section of the stretch cam member 174 (below shaft 176) is attached to stretch link 180. Stretch link 180 is further connected to one end of stretch member 184 via stretch link joint 182. The opposite end of the stretch member 184 is attached to the die pedestal base 136 by way of attachment member 186. As explained generally above, this pedestal base 136 (and the bend die components above it) can move along linear slide rails 156, 158 via linear slides 148, 150, 152, 154 in a longitudinal L direction. Therefore, any longitudinal L movement of the various stretch link members 180, 184, 186 will likewise longitudinally move the die pedestal 134 via the die pedestal base 136. Moving the die pedestal 134 longitudinally to the right will impart a longitudinal L stress on the mounted extrusion 50 because one end 58 of the extrusion 50 is fixedly mounted in the fixed clamping device 132 on the die pedestal 134 and the other end 60 of the mounted extrusion 50 is mounted in the gripper hook 128 which can not move longitudinally (because the four-post die set is fixed to the lower platen or base 106).

Stretching occurs as follows. As the upper platen assembly 102 moves downward, the stretch cam 126 moves down to engage cam follower 172. According to the profile of the cam 126, the cam follower 172 will be forced away from the cam ("following" the profile of the latter). Because the cam follower 172 is connected to stretch cam member 174 to rotate about shaft 176, the force on the cam follower 172 will cause the stretch cam member 174 to rotate in a counterclockwise direction around shaft 176. This counterclockwise rotation will force stretch link 180 to push stretch member 184 and attachment member 186 in the negative longitudinal direction (to the right in FIG. 10). Attachment member 186 will push the die pedestal 134 (by pushing the die pedestal base 136) in the negative longitudinal direction also. Because one end of the extrusion 60 is fixed to the apparatus base 106 through the lower guide members 108, 110, 112, 114 and the other end 58 is fixed to the now-moving die pedestal 134 (through the fixed clamping device 132), a longitudinal L stretch is imposed on the mounted extrusion 50. The amount of the stretch can be varied throughout the process cycle by altering the size and profile of the stretch cam 126. In all, an appropriate amount of stretch, for example based on keeping the extrusion 50 stretched just beyond plasticity, can be imparted on the mounted extrusion 50 throughout the formation process. It will also be appreciated that the shape of cam 126 can be precisely tailored so as to effect essentially any desired stretching protocol.

When the bending and/or twisting cycle is complete, and the upper platen assembly 102 is raised up to its starting position, the stretch cam 126 will move clear of the stretch cam follower 172. This will stop the longitudinal and rotational forces imparted by the stretch cam 126 during the process cycle. A stretch return cylinder 188 is mounted via cylinder base 192 on the upper side of the lower linear slide base 159. The cylinder 188 acts as a spring and biases the attachment member 186 in the positive longitudinal L direction via the cylinder member 190. Therefore, when the stretch cam 126 is not engaged with the cam follower 172, this cylinder 188 will urge the attachment member 186, stretch member 184 and stretch link 180 in the positive longitudinal direction (i.e.: to the left). This biasing will rotate the stretch cam member 174 in the clockwise direction, and prepare the cam follower 172 to once again engage the stretch cam 126 during the next formation cycle. In this way, the stretch can be performed and the apparatus 100 can "reset" itself after every process run with little or no human interaction or complex components.

The foregoing description details a single process step that can impart a predefined amount of stretch on a mounted extrusion. However, the apparatus 100 can be adapted to allow the extrusion 50 to be bent in one or more planes and/or twisted while this same single process step is being performed. Particularly, the apparatus of FIGS. 10 and 11 is able to impart a bend on a mounted extrusion 50 as part of a single process step. The bend described as part of a presently preferred embodiment of the present invention will bend the extrusion 50 along the longitudinal axis L through the vertical plane.

Thus, die pedestal 134 is configured for gripping and bending a mounted extrusion 50 in one plane. The die pedestal 134 is comprised of a die pedestal base 136 and two vertical support members 138, 144. At least one of the vertical support members 144 may be adjustable in height to accommodate different bend dies 200. A die carriage holder 142 is preferably connected to the tops of the vertical support members 138, 144. In FIG. 10, the connections are shown as pivot points 140, 146 to allow the die carriage holder 142 to adapt to various adjustable vertical member 144 heights.

The fixed clamping device 132 is mounted at the upper end of the die carriage holder 142. A bend die 200 is mounted along the top side of the die carriage holder 142. As the upper platen assembly 102 is forced downwards, the gripper hook 128 will engage the free end 60 of the mounted extrusion 50 as described above. As the upper platen assembly 102 and gripper hook 128 continue downwards, a downward force is exerted by the gripper hook 128 on the free end 60 of the mounted extrusion 50. Because the fixed clamping device 132 does not allow that end 58 of the mounted extrusion 50 to move, the gripper hook 128 will pull the extrusion 50 down and over the bend die 200.

Hence, through one complete process cycle, the extrusion 50 is bent along its longitudinal axis L in the vertical plane according to the profile of the bend die 200. As the bend die 200 approaches an orientation generally parallel to the lower platen or base 106, the degree of bend imparted to the mounted extrusion 50 will be reduced. As the bend die 200 angle is steeper, the bend will increase. Also, by tailoring the profile of the bend die 200, the bend imparted to the extrusion 50 can be made more complex.

After the bend cycle is completed, the upper platen assembly 102 is moved upwards to its original starting position. As the upper platen 104 moves the gripper hook 128 up, the extended cylinder 68 on the end 60 of the mounted extrusion 50 will slide out from under the gripper hook 128 to facilitate dismounting of the extrusion 50. Then, a new extrusion 50 to be bent and/or twisted that has been mounted with gripper mounts 62, 64 on either side 58, 60 can be quickly mounted in the bending apparatus 100. The one step stretch-bend or stretch-bend-twist (described below) cycle can then be started on the new extrusion 50 with little or no delay. Such ease of mounting and dismounting the material 50 may be well suited to a mass-manufacture environment including robotics.

Although the above bending process was presented with respect to a simple die-based stretch bend and the above stretch process was presented with respect to a simple cam and follower linkage, the present invention contemplates many variations of the apparatus and materials described above.

Figure 14:
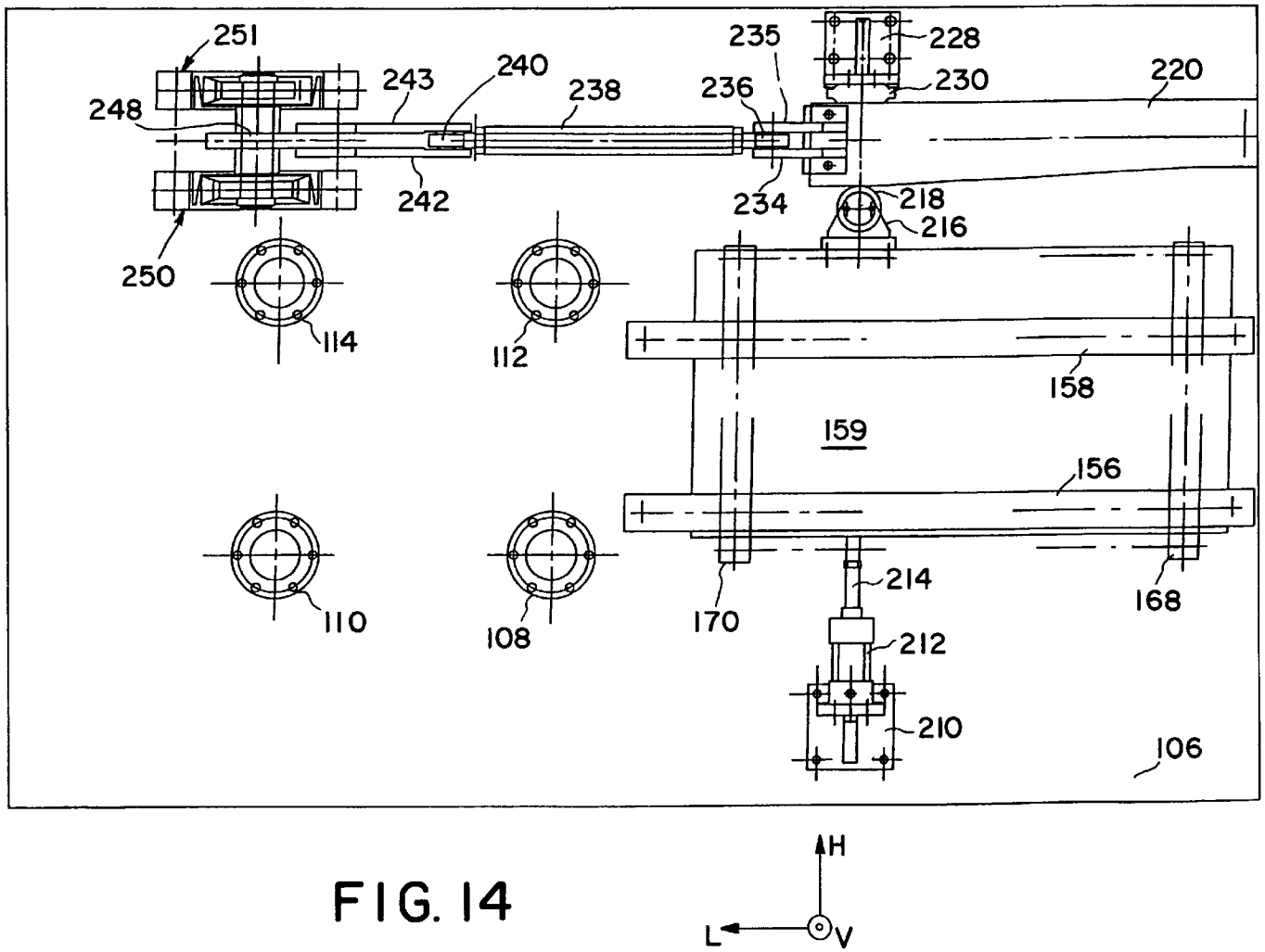
FIG. 14 shows a top view of bending components of one embodiment of the present invention with some components removed for clarity.

In another aspect of a preferred embodiment of the present invention, a second bend, in a different plane than the first bend can be imparted on the mounted extrusion 50. For instance, FIGS. 14 through 16 detail one preferred way to impart a second bend to a hollow extrusion 50 in a plane that is generally perpendicular to the first bend. In each of these drawings, some components have been removed for clarity. FIG. 14 generally shows the lower platen or base 106 with markings indicating the position of the lower guide members 108, 110, 112, 114. The linear slide base 159 is shown with the two upper linear slide tracks 156, 158 attached to the top side of linear slide base 159. Underneath the linear slide base 159 are the two lower linear slide tracks 168, 170 (shown as partial lines in FIG. 14). There is a cylinder 212 coupled to the linear slide base 159 by way of a coupling member 214. The cylinder 212 is attached to the lower platen base 102 by way of cylinder base 210. This cylinder 212 can act as a spring or other biasing device that biases the linear slide base 159 (and everything attached above it) in the positive horizontal direction. On the opposite side of the linear slide base 159 is a small cam 218 attached to a cam mount 216 for imparting the second or out of plane bend on the hollow extrusion 50.

Figure 15:
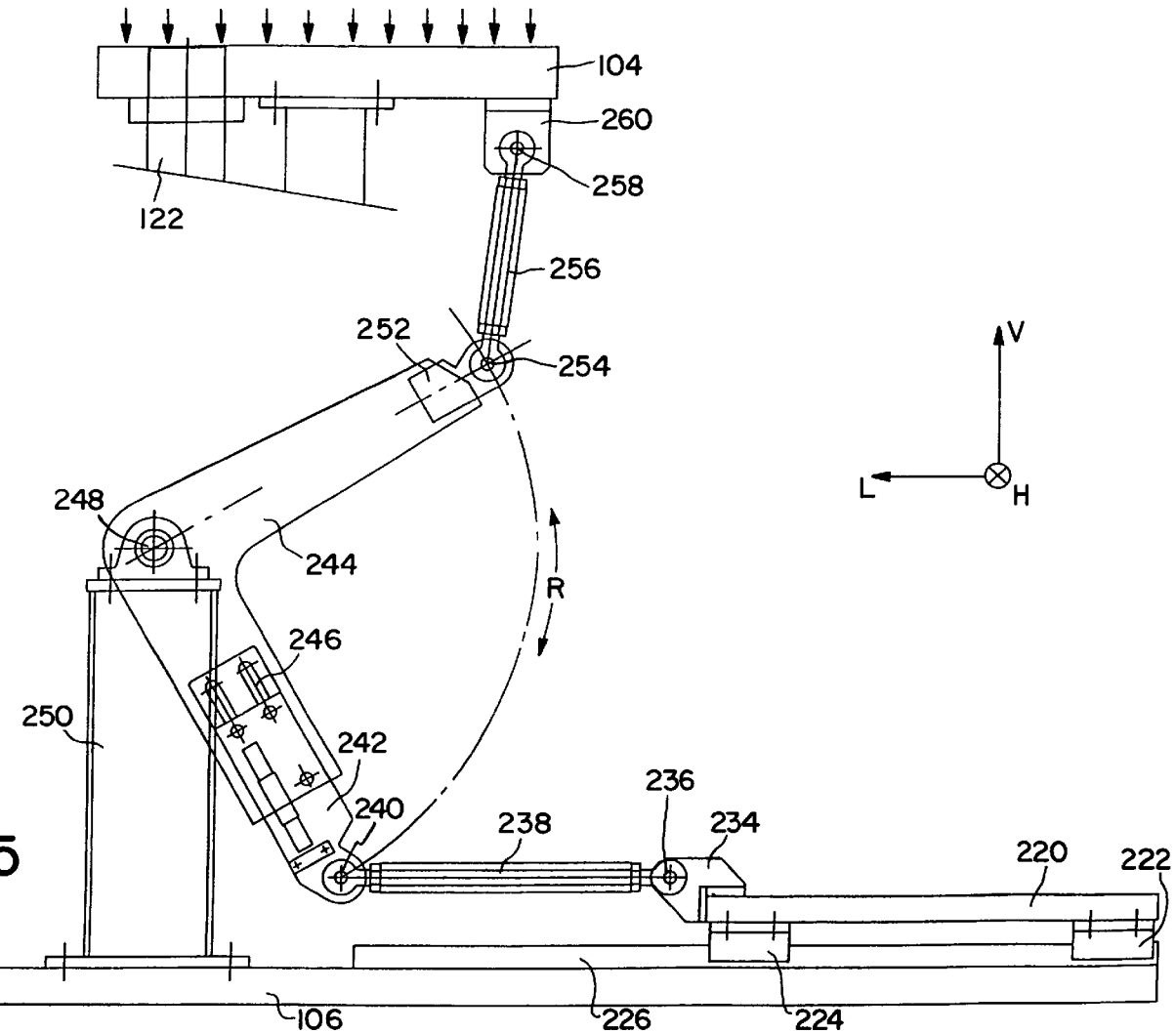
FIG. 15 shows a front view of the bending components of FIG. 14.

FIG. 15 generally shows a bell crank mechanism for imparting the motion to the mounted extrusion 50 that creates a second bend in the workpiece 50. There is preferably a linear slide track 226 or other suitable substitute mounted on the upper side of the lower platen or base 106. Two linear slides 222, 224 slidingly engage this linear slide track 226 from above. The tops of these two linear slides 222, 224 are fixed to the bottom of a cam 220 for use with the previously described cam follower 218. This allows the cam follower 218 to slide along the longitudinal axis L.

The motion of the cam follower 218 stems from the movement of the bell crank 244. The center 248 of the elbow crank 244 is attached to a shaft between the top of crank fulcrum supports 250, 251. This shaft 248 allows the crank 244 to rotate in a vertical plane that is perpendicular to the horizontal axis H. This rotation is shown as R in FIG. 15. The crank 244 is connected to both the upper platen 104 and the out-of-plane bend cam 220. This connection is achieved through an upper link member 256 that is connected to the crank 248 by way of attachment members 252, 253 and is connected to the upper platen 104 by an upper pivot joint 258. The lower crank connection is through a lower link member 238 that is connected to the crank 248 by way of attachment members 242, 243 and is connected to the cam 220 by way of attachment members 234, 235. Minor adjustments to the length of the bell crank mechanism can be accomplished through the adjustment slots 246.

The basic motion associated with the out-of-plane bending can best be seen in FIG. 15. As the upper platen assembly 102 moves down (either hydraulically or by way of an equivalently functioning medium), the upper member 256 forces the top of the crank 244 in a downward direction. Because of the fixed axis 248, the crank 244 rotates along R so that the lower part of the crank 244 moves in a generally longitudinal direction L. This longitudinal "pull" forces the lower link member 238 to move the cam 220 in a longitudinal direction also. Therefore, as the upper platen assembly 102 moves down, the out of plane bend cam 220 moves longitudinally (to the left).

Looking back at FIG. 14, it is shown that the cam 220 also preferably has a cam bias device 230 associated therewith that is attached to the lower platen or base 106 by way of a cam biasing base member 228. This cam biasing device 230 prevents the cam 220 from displacing in the horizontal direction H, but allows the cam 220 to freely move in the longitudinal direction L. In all, the cylinder 212 biases the linear slide base 159 against the cam 220 via the cam follower 218. Therefore, as the cam 220 moves longitudinally, the cam follower 218 will follow the profile of the cam 220 and move the linear slide 159 in a horizontal direction H. Because the hollow extrusion 50 is fixedly mounted above the linear slide base 159 (as described above), the mounted extrusion 50 will be bent in a plane that is perpendicular to the previous bend.

The profile or varying horizontal thickness of the cam 220 will determine how much the mounted extrusion 50 is bent in this second plane. As the difference between the thickest and the thinnest parts of the cam 220 increase, the extrusion's 50 second bend will increase likewise. Specifically, the further that the linear slide 159 is moved in the horizontal direction H, the greater the bend of the extrusion 50 as the fixed end 58 is moved horizontally with respect to the "free" end 60.

The above description of the second bending according to one embodiment of the present invention utilized specific components only by way of example. For instance, a bell crank mechanism need not necessarily be used to impart the translation of motion from one plane to another, and the cam 220 need not necessarily be attached to a linear slide. Thus, the present invention, in accordance with at least one embodiment, is to be construed as broadly encompassing all suitable mechanical or other media that allow the translation of motion from one plane to another while forcing the ends 58, 60 of the extrusion 50 to be moved horizontally with respect to each other in accordance with a predetermined profile, aspect or pattern.

Figure 16:
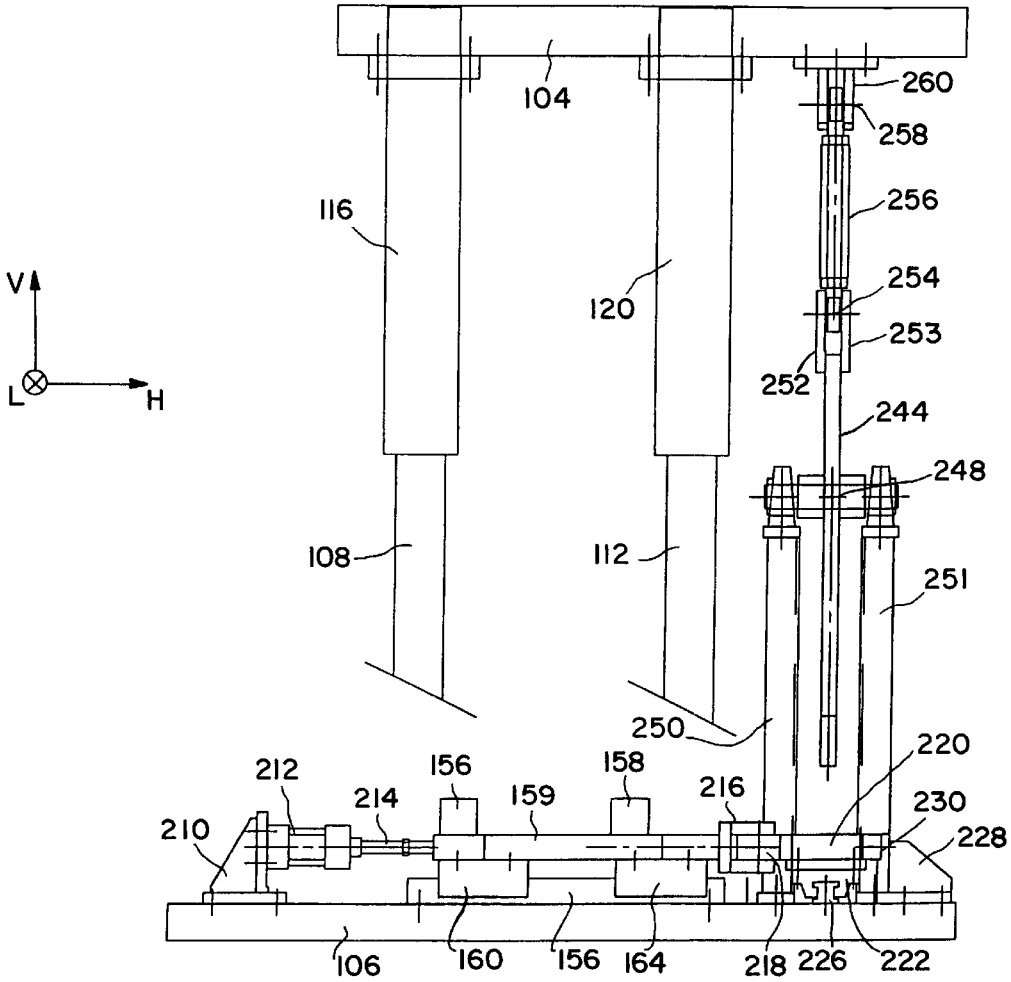
FIG. 16 shows a side view of the bending components of FIG. 14.

FIG. 16 provides some additional depth and understanding with respect to the previous two figures. FIGS. 14–16, taken as a whole, provide details of one embodiment of a second, out of plane bend, in accordance with the present invention.

Figure 18:
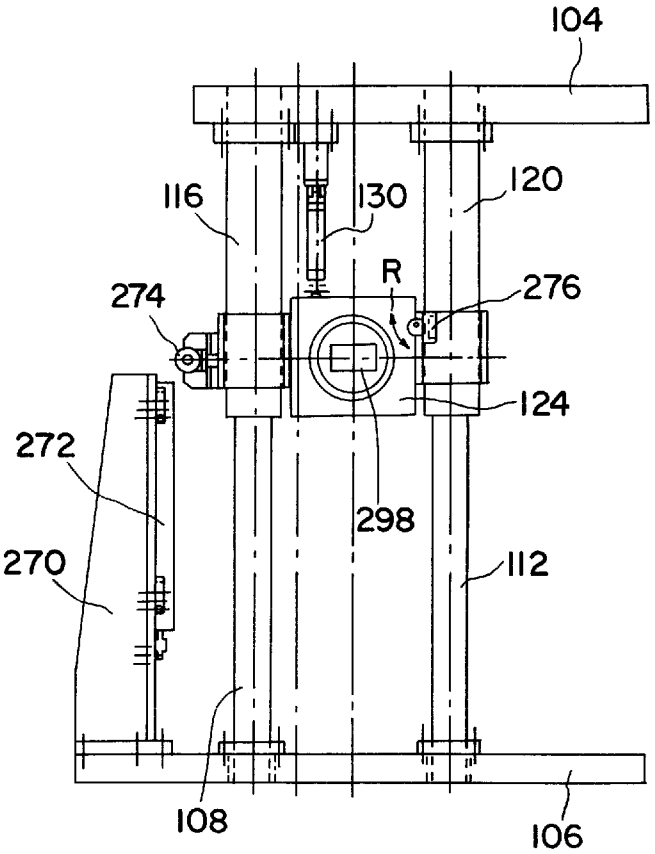
FIG. 18 shows a side view of the twisting components of FIG. 17.
Figure 17:
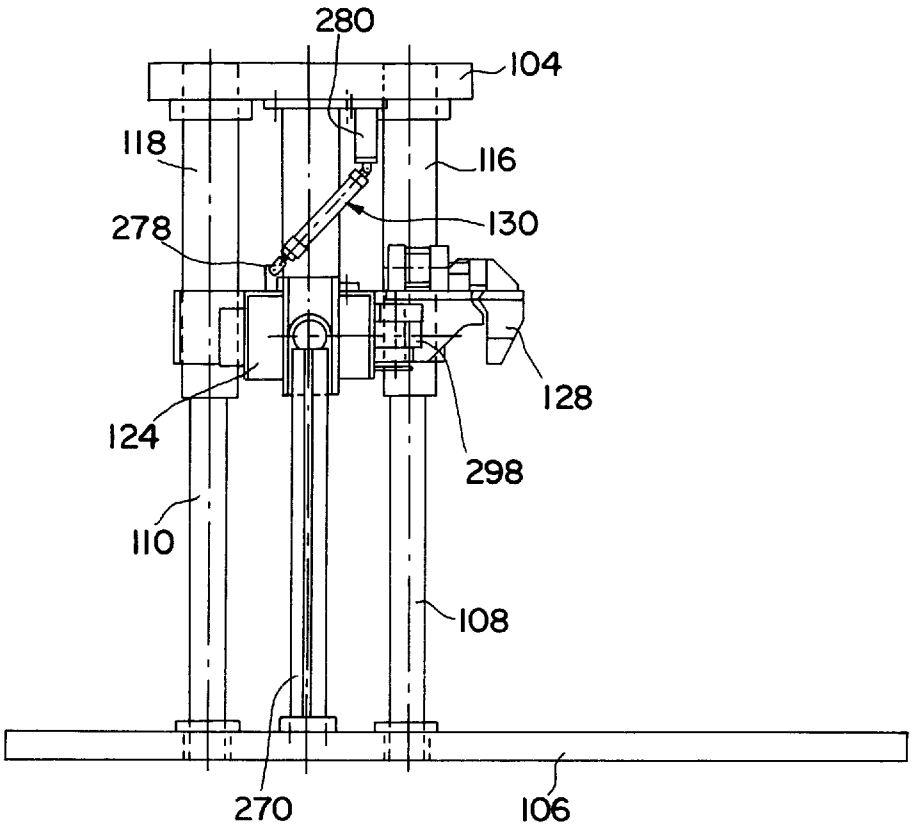
FIG. 17 shows a front view of twisting components of one embodiment of the present invention with some components removed for clarity.

At the same time that one or more stretches or bends is imparted to the mounted extrusion 50, the extrusion 50 can also be twisted around its longitudinal axis L. FIGS. 17 and 18 show one embodiment of the present invention that encompasses such twisting. FIG. 17 generally shows a front view of the bend head 124 with gripper hook 128 mounted as part of the upper platen assembly 102 onto the upper guide members 116, 118, 120, 122. FIG. 18 shows a side view of the same twisting components.

As with the stretch and the out-of-plane bend, the twist in this exemplary embodiment is accomplished by way of a cam 272 and follower 274. The cam 272 containing the twist profile is mounted on a twist cam base 270 that is thereby mounted to the lower platen or base 106. The cam follower 274 is mounted to one end of the bend head 124. As the movement of the upper platen 104 forces the bend head 124 downwards, the cam follower 274 comes into contact with the twist cam 272 with twist profile. As the bend head 124 and upper platen assembly 102 are moved downward still, the cam follower 274, which is biased against the twist cam 272, will follow the profile of the twist cam 272. As the cam follower 274 follows the cam 124 profile, it imparts a rotation on the bend head 124, that causes the bend head 124 to rotate along the R axis (FIG. 18). The fulcrum of this rotation is twist joint 276. The front of the bend head 124 is attached to the gripper hook 128 which holds the mounted extrusion 50. Hence, as the twist cam follower 274 is forced in the horizontal direction H, the bend head 124, the gripper hook 128, and the extrusion 50 are rotated.

There is also a restoring cylinder 130 linking the bend head 124 to the upper platen 104. The restoring cylinder 130 is linked to the upper platen 104 by the upper attachment member 280 and is linked to the bend head 124 by the lower attachment member 278. As the bend head 124 rotates or twists, the restoring cylinder 130 expands along its longest axis. The cylinder 130 essentially acts like a spring, and allows expansion under force. At the end of the forming cycle (after the extrusion 50 is dismounted), when the upper platen assembly 102 allows the cam follower 274 to clear the twist cam 272, there is no longer a twist force imparted on the bend head 124. Therefore, the restoring cylinder 130 will no longer have a stretch force on it, and the restoring cylinder 130 will recoil and return to its original, unstretched position. This recoiling will also rotate the bend head 124 (and everything attached to it) back to its original upright position (untwisted).

Figure 19:
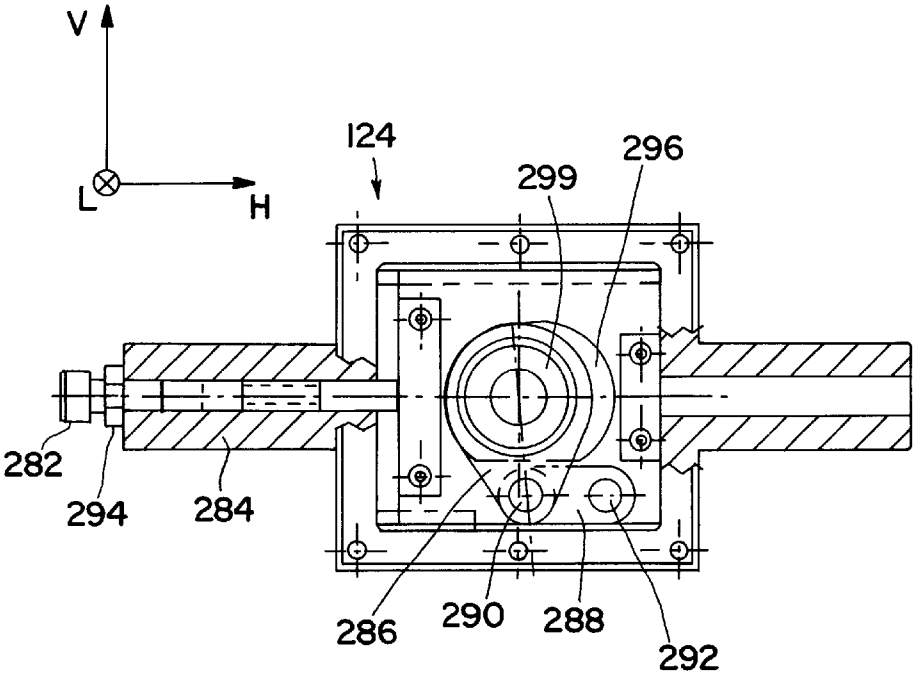
FIG. 19 shows a side partial section view of a bend head.

The above description explains one possible embodiment of the twisting of a mounted extrusion 50. To aid in clarity, FIGS. 19 and 20 detail the interior workings of one possible embodiment of the bend head 124 of the present invention. Specifically, FIG. 19 shows a plunger 282 that is attached to the twist cam follower 274. The plunger 282 shaft extends throughout the hollow shaft formed by the bend head's exterior cylinders 284. The plunger 282 is biased against the bend head 124 by retaining ring 294. As the cam follower 274 follows the twist cam 272, the plunger 282 is forced horizontally against the bend head 124, causing the bend head 124 to move horizontally along line H.

Figure 20:
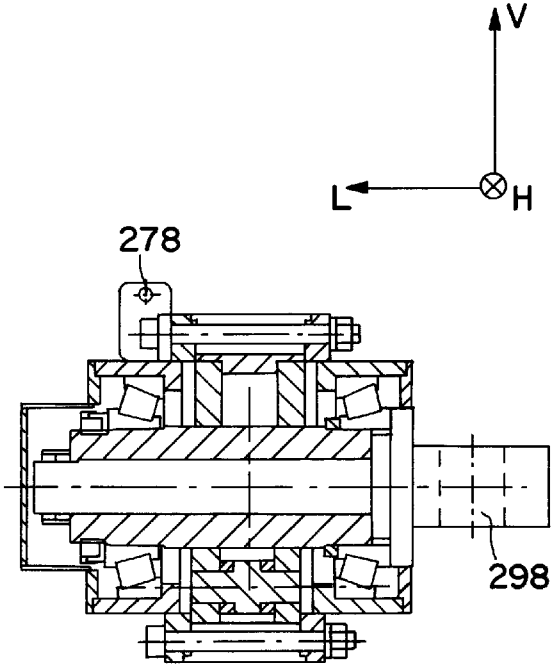
FIG. 20 shows a front partial section view of the bend head of FIG. 19.

The interior of the bend head 124 is characterized by two links 286, 288 that are rotatingly joined together. The fixed link 288 has one end fixed to the bend head 124. This end allows rotation around the fixed link axis 292. Such a fixation allows the fixed link 288 to rotate around this center point 292. The opposite end of the fixed link 288 is attached to a rotating link 286. The axis 290 joining these two links 286, 288 is not fixed to the bend head 124. Therefore, the rotating link 286 has relatively free rotational movement in the rotation space 296. As seen in FIG. 20, the upper part 299 of the rotating link 286 is attached to the gripper hook mount 298. As previously described, the gripper hook 128 (holding one end 60 of the mounted extrusion 50) is securely mounted to this gripper hook mount 298.

As the twist cam follower 274 follows cam 272 and forces plunger 282 in a horizontal direction H, the retaining ring 294 forces the bend head shaft 284 (and, hence, the entire bend head 124) in the horizontal direction. As the bend head 124 moves in the horizontal direction, it takes the fixed end 292 of the fixed link 288 with it. This pulls the rotating link axis horizontally, which pulls on the rotating link 286. However, because the upper part 299 of the rotating link 286 is fixed to the gripper hook mount 298, the rotating link 286 can not move in the horizontal direction. Therefore, the rotating link 286 will rotate, or twist, in a counterclockwise direction because of the force exerted on the rotating link 286 by the fixed link 288. This rotational or twisting movement will be directly translated to the gripper hook 128 through the gripper hook mount 298, and hence, will likewise rotate or twist the mounted extrusion 50 in a plane that is perpendicular to the extrusion's longitudinal axis L. In this way, a simple cam (272) and follower (274) arrangement can be used to impart a complex rotational twisting to the mounted hollow extrusion 50.

The above-described twisting works because of the same downward ram-like force of the upper platen assembly 102 as used to impart the previous stretch and two bends on the mounted extrusion 50. As in those cases, the twist cam follower 274 and two link 286, 288 system is presented merely as an example of how such a twist may be imparted on the extrusion 50. Nothing in the above description is meant to limit the above twist, or any other movement, to a specific piece of machinery or collection of mechanical parts. Many part substitutions are contemplated, and any way that the mechanical press movement can be automatically translated into a twisting movement is within the scope of at least one embodiment of the present invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

What is claimed is:

1. An apparatus for forming hollow extrusions, comprised of:

a frame;

a stretcher for stretching the hollow extrusion along a longitudinal axis of the extrusion;

a first bender for bending the hollow extrusion; and a second bender for bending the hollow extrusion in a different plane than does said first bender.

2. The apparatus of claim 1, further including:

a twister for twisting the hollow extrusion in a plane that is perpendicular to the longitudinal axis of the extrusion.

3. The apparatus of claim 2, wherein said stretcher, said second bender, and said twister include at least one cam and follower arrangement for facilitating at least one of: stretching, bending, and twisting.

4. The apparatus of claim 2, further including a force transmission arrangement for mechanically moving at least part of the apparatus.

5. The apparatus of claim 4, wherein said force transmission arrangement is adapted to substantially simultaneously cause: the stretcher to stretch the extrusion, the first bender to bend the extrusion, the second bender to bend the extrusion, and the twister to twist the extrusion.

6. The apparatus of claim 5, wherein said force transmission arrangement is selected form the group consisting of: a ram, a hydraulic press, and a mechanical press.

7. The apparatus of claim 1, further including: a gripper for holding the hollow extrusion during formation.

8. The apparatus of claim 7, wherein said gripper is selectively detachable from the remainder of said apparatus.

9. The apparatus of claim 7, wherein said gripper is fixedly attached to another portion of said apparatus.

10. An apparatus for forming hollow extrusions, said apparatus comprising:

a gripper mount for holding one end of a hollow extrusion;

a bend die for forming a first bend in the hollow extrusion;

a first cam and first follower for imparting a stretch along a longitudinal axis of the extrusion;

a second cam and second follower for forming a second bend in the hollow extrusion along a plane that is different than the plane of the first bend; and a third cam and third follower for twisting the hollow extrusion along a plane that is generally perpendicular to the longitudinal axis of the extrusion.

11. The apparatus of claim 10, further including a gripper hook for dynamically mounting a free end of the hollow extrusion during the use of the apparatus.

12. The apparatus of claim 10, further including a bend head for acting in conjunction with said third cam and third follower to twist the hollow extrusion.

13. The apparatus of claim 10, further including an upper platen for translating an external mechanical force into a force for imparting a stretch, plurality of bends, and a twist on the hollow extrusion.

14. A method for forming hollow extrusions, said method comprising:

mounting a hollow extrusion in a formation apparatus;

stretching the hollow extrusion along a longitudinal axis thereof;

bending the hollow extrusion in one plane;

bending the hollow extrusion in another plane different than the one plane; and twisting the hollow extrusion in a plane that is generally perpendicular to the longitudinal axis of the hollow extrusion.

15. The method of claim 14, further including:

providing gripper mounts that are removable from the formation apparatus; and mounting the hollow extrusion in removable gripper mounts prior to mounting the hollow extrusion in said formation apparatus.

16. A method for forming hollow extrusions, said method comprising:

mounting a hollow extrusion in a formation apparatus;

stretching the hollow extrusion along a longitudinal axis thereof;

bending the hollow extrusion in a first plane that is generally parallel to the longitudinal axis of the hollow extrusion; and bending the hollow extrusion in a second plane that is generally parallel to the longitudinal axis of the hollow extrusion, wherein said second plane is different than said first plane.

17. The method of claim 16, further including:

twisting the hollow extrusion in a plane that is generally perpendicular to a longitudinal axis of the hollow extrusion.

18. The method of claim 17, wherein said stretching, said bending in at least two planes, and said twisting all occur as the result of a force applied to a portion of said formation apparatus.

19. The method of claim 18, wherein said stretching, said bending in at least two planes, and said twisting all occur at substantially the same time.

* * * * *